US011958668B2

(12) United States Patent
Fogg et al.

(10) Patent No.: US 11,958,668 B2
(45) Date of Patent: Apr. 16, 2024

(54) INSULATED COOLER

(71) Applicant: Tractor Supply Co. of Texas, LP, Brentwood, TN (US)

(72) Inventors: Christian D. Fogg, Columbia, TN (US); Spencer Carpenter, Lewisburg, TN (US); Wei Hui, Shanghai (CN)

(73) Assignee: Tractor Supply Co. of Texas, LP, Brentwood, TN (US)

( * ) Notice: Subject to any disclaimer, the term of this patent is extended or adjusted under 35 U.S.C. 154(b) by 224 days.

(21) Appl. No.: 17/686,834

(22) Filed: Mar. 4, 2022

(65) Prior Publication Data

US 2023/0278762 A1 Sep. 7, 2023

(51) Int. Cl.
*B65D 51/16* (2006.01)
*F25D 3/08* (2006.01)

(52) U.S. Cl.
CPC ..... *B65D 51/1694* (2013.01); *F25D 3/08* (2013.01); *F25D 2331/804* (2013.01)

(58) Field of Classification Search
CPC . B65D 51/1694; F25D 3/08; F25D 2331/804; F25D 17/047
USPC ..... 220/785
See application file for complete search history.

(56) References Cited

U.S. PATENT DOCUMENTS 3,133,664 A 5/1964 Koch
3,951,293 A 4/1976 Schulz
4,545,213 A 10/1985 Fujiwara et al.
5,171,439 A 12/1992 Vakharia
5,417,743 A 5/1995 Dauber
6,003,719 A 12/1999 Stewart, III
9,919,850 B2 3/2018 Bons et al.
9,932,165 B2 4/2018 Wooldridge et al.
10,464,734 B2 11/2019 Wooldridge et al.
10,486,887 B2 11/2019 Wooldridge et al.
10,486,888 B2 11/2019 Wooldridge et al.
11,434,052 B2 * 9/2022 Stephens ..... B65D 25/14
2005/0109776 A1 * 5/2005 Camp, Jr. ..... A45C 11/20 220/23.86

(Continued)

FOREIGN PATENT DOCUMENTS

CN 205173554 U 4/2016
CN 206885737 U 1/2018
EP 826607 A1 3/1998

*Primary Examiner* — Ernesto A Grano
(74) *Attorney, Agent, or Firm* — Lucian Wayne Beavers; Patterson Intellectual Property Law, PC

(57) ABSTRACT

An insulated cooler having an insulated bottom, an insulated peripheral wall, and an insulated lid is disclosed. The peripheral wall may extend up from the bottom to define an interior space of the cooler. The lid, pivotally attached to the peripheral wall, may be pivotable to a closed position engaging the peripheral wall to close the interior space. A vent passage may extend through the peripheral wall or the lid, communicating the interior space with an exterior of the cooler to prevent formation of a vacuum in the cooler. A retaining frame may be attached to the peripheral wall or the lid at a location on the peripheral wall or the lid corresponding to a location of the vent passage. An air-impermeable, water-impermeable material layer may block the vent passage. The material layer may be positioned between the retaining frame and the interior space of the cooler.

17 Claims, 12 Drawing Sheets

(56) References Cited

U.S. PATENT DOCUMENTS

| | | | | |
|---|---|---|---|---|
| 2005/0150251 | A1* | 7/2005 | Navedo | F24F 5/0017 62/530 |
| 2006/0000221 | A1* | 1/2006 | Culp | F25B 21/02 62/3.6 |
| 2009/0120939 | A1 | 5/2009 | Wang et al. | |
| 2014/0283691 | A1 | 9/2014 | Furuuchi | |
| 2015/0238033 | A1* | 8/2015 | Zavitsanos | A45C 11/20 220/592.2 |
| 2016/0367782 | A1 | 12/2016 | Henry et al. | |
| 2017/0029997 | A1* | 2/2017 | Feinberg | D06F 1/00 |
| 2017/0119116 | A1* | 5/2017 | Bradley | A45C 13/36 |
| 2021/0188521 | A1* | 6/2021 | Stephens | B65D 81/3823 |
| 2022/0297919 | A1* | 9/2022 | Stephens | B65D 81/3823 |
| 2023/0329489 | A1* | 10/2023 | Franklin | A47J 47/14 |

* cited by examiner

INSULATED COOLER

FIELD OF THE DISCLOSURE

The present disclosure relates generally to an insulated cooler.

BACKGROUND

In recent years, high-efficiency coolers have become very popular. These coolers are designed to maintain ice in the coolers for several days, thereby providing for cool storage of food, drinks, or other items held in the cooler. While these high-efficiency coolers may generally maintain a difference of temperature between an inside of the cooler and an outside of the cooler, one problem that is sometimes encountered with such high-efficiency coolers is that a relative vacuum may form within the cooler to an extent that it is difficult for a user to open the lid of the cooler. This vacuum is formed by a pressure differential between the low pressure within the cooler as compared to atmospheric pressure outside of the cooler. This pressure differential occurs because the ice (or another cooling agent) in the cooler causes the entrapped air within the cooler to contract, and the lid is so well sealed to the body of the cooler that no air can leak into the cooler, thus the contraction of the air reduces the pressure within the cooler.

To prevent the formation of such pressure differential between the outside and the inside of the high-efficiency coolers, various solutions have been proposed.

For example, some models of insulated coolers have a vacuum release button, or pressure relief valve, attached to a peripheral wall of the insulated cooler. By activating the release button or the relief valve, the pressure differential between the inside and the outside of the insulated cooler may be neutralized. Such a cooler with a vacuum relief valve is shown in U.S. Pat. No. 10,486,887, entitled "Vacuum Cooler" (hereinafter, the "'887 Patent"). The '887 Patent discloses a vacuum release assembly disposed in the peripheral wall or the lid of the insulated cooler. The vacuum release assembly includes an outside air exhaust, or intake opening, through which air from the outside of the insulated cooler may enter the inside of the insulated cooler. And, the vacuum release assembly further includes a plunger that is selectively movable relative to the opening, so as to allow air from the exterior space to enter the inside of the insulated cooler. By allowing this airflow, the pressure differential between the inside and the outside may be neutralized.

But, the addition of a vacuum relief valve to a cooler is an expensive and unsightly way of solving the problem of vacuum creation in such coolers. Thus, there is a need for solutions to the problem of vacuum creation other than the use of such vacuum release valves.

BRIEF SUMMARY

The present disclosure provides a unique solution to the problem of vacuum creation in high efficiency coolers by preventing the creation of such a vacuum, rather than having to incorporate a vacuum release valve or other structure to eliminate the vacuum after it is created. This unique solution also ensures that a difference of temperature is generally maintained between an interior space of the high-efficiency cooler and an exterior space of the cooler, thereby preserving a useful life or quality of items held in storage within the interior space of the cooler, such as food, drinks, or other thermally sensitive items.

The present disclosure provides an insulated cooler, or an insulated container, having an insulated bottom, an insulated peripheral wall, and an insulated lid. The peripheral wall may extend from the bottom such that the bottom and the peripheral wall define an interior space of the cooler, and the lid may be pivotably attached to the peripheral wall and pivotable to a closed position where the lid is engaged to the peripheral wall, thereby closing the interior space from the cooler. Closing the interior space enables a difference of temperature to be generally maintained between the interior space of the cooler and an exterior of the cooler. To prevent formation of vacuum in the cooler, a vent passage may be provided in, or bored through, the peripheral wall or the lid, and the vent passage may extend through the peripheral wall or the lid. The vent passage communicates the interior space of the cooler with the exterior. To allow air flow through the vent passage, and to prevent water, or other liquified contents, from leaking out of the vent passage, an air-permeable, water-impermeable material layer may block the vent passage. A retaining frame, which is attached to the peripheral wall or the lid, may hold the material layer in place relative to the vent passage, or the material layer may be positioned between the retaining frame and the interior space of the container. The vent passage, coupled with the air-permeable, water-impermeable material layer, may prevent a vacuum from forming in the interior space of the insulated cooler, maintain a temperature differential between the interior space and the exterior of the insulated cooler, and prevent water, or other liquified contents, from leaking out of the insulated cooler visà-vis the vent passage. And, the retaining frame may cover and conceal the vent passage and the material layer from a user of the cooler, thereby bolstering or maintaining an aesthetic value of an embodiment of the cooler.

In the context of an insulated cooler, the insulated cooler having an insulated bottom, an insulated peripheral wall, and an insulated lid is provided. The peripheral wall may extend up from the bottom such that the bottom and the peripheral wall define an interior space of the cooler. The lid may be pivotally attached to the peripheral wall. The lid may be pivotable to a closed position where the lid engages the peripheral wall to close the interior space. A vent passage may extend through the peripheral wall or the lid. The vent passage may communicate the interior space of the cooler with an exterior of the cooler to prevent formation of a vacuum in the cooler. An air-impermeable, water-impermeable material layer may block the vent passage, so as to allow air flow through the vent passage while preventing water from leaking out of the vent passage. And, a retaining frame may be attached to the peripheral wall or the lid, and the retaining frame may hold the material layer in place relative to the vent passage.

In the context of an insulated container, the insulated container having a bottom, a peripheral wall, and a lid is provided. The peripheral wall may extend up from the bottom such that the bottom and peripheral wall define an interior space of the container. The lid may be pivotally attached to the peripheral wall. The lid may be pivotable to a closed position where the lid engages the peripheral wall to close the interior space. Where the lid is in the closed position, a difference of temperature may be generally maintained between the interior space of the container and an exterior of the container. A vent passage may extend through the peripheral wall or the lid. The vent passage may communicate the interior space of the exterior of the container to prevent formation of a suction seal between the lid and peripheral wall when the lid engages the peripheral wall in the closed position. A retaining frame may be attached to the peripheral wall or the lid at a location on the peripheral wall or the lid corresponding to a location of the vent passage. An air-permeable, water-impermeable material layer may block the vent passage, so as to allow air flow through the vent passage while preventing water from leaking out of the vent passage. The material layer may be positioned between the retaining frame and the interior space of the container.

In the context of a cooler, a method of preventing a vacuum, and maintaining a temperature differential, in the cooler is provided. The method may commence with a step of providing a vent passage through an insulated peripheral wall of the cooler or an insulated lid of the cooler. The peripheral wall may extend up from the bottom such that the bottom and the peripheral wall define an interior space of the cooler. The method may continue with a step of blocking the vent passage with an air-permeable, water-impermeable material layer, thereby allowing air flow through the vent passage while preventing water from leaking out of the vent passage.

In one particular and exemplary embodiment, an insulated cooler is provided. The cooler includes an insulated bottom, an insulated peripheral wall, and an insulated lid. The peripheral wall extends up from the bottom such that the bottom and the peripheral wall define an interior space of the cooler. The lid is pivotally attached to the peripheral wall. The lid is pivotable to a closed position engaging the peripheral wall to close the interior space. A vent passage extends through the peripheral wall or the lid. The vent passage communicates the interior space of the cooler to prevent formation of a vacuum in the cooler. An air-permeable, water-impermeable material layer blocks the vent passage to allow air flow through the vent passage while preventing water from leaking out of the vent passage. A retaining frame is attached to the peripheral wall or the lid to hold the material layer in place relative to the vent passage.

In one aspect according to the above-referenced embodiment, the insulated cooler may further include a latch arm. The latch arm may be pivotably attached to the lid. And, the retaining frame may include a latch seat. The latch seat may be configured to be engaged by the latch arm when the lid is in the closed position.

In another aspect according to the above-referenced embodiment, the vent passage may extend through the peripheral wall. The latch arm may cover and conceal the vent passage and the material layer when the latch arm is engaged with the latch seat.

In another aspect according to the above-referenced embodiment, the vent passage may extend through the lid. The retaining frame may comprise a plate, and the plate may be attached to the lid to hold the material layer in place relative to the vent passage. And, the plate may cover and conceal the vent passage and the material layer.

In another aspect according to the above-referenced embodiment, the vent passage may be generally circulated shaped. The vent passage may have a diameter ranging from about 4 millimeters (mm) to about 6 millimeters (mm).

In another aspect according to the above-referenced embodiment, the material layer may be generally circularly shaped. The material layer may have a diameter greater than or equal to the diameter of the vent passage.

In another aspect according to the above-referenced embodiment, the material layer may comprise at least one of expanded polytetrafluoroethylene (ePTFE) or other suitable air permeable-water impermeable materials.

In another aspect according to the above-referenced embodiment, the material layer may have a thickness ranging from about 0.1 mm to about 0.3 mm.

In another aspect according to the above-referenced embodiment, the peripheral wall may comprise an insulated first sidewall, an insulated second sidewall, an insulated front wall, and an insulated backwall. The first sidewall, the second sidewall, the front wall, and the backwall may extend up from the bottom to define the interior space of the cooler.

In another aspect according to the above-referenced embodiment, the lid may be pivotably attached to the backwall. The lid may be pivotable to the closed position engaging the first sidewall, the second sidewall, the front wall, and the backwall to close the interior space.

In one particular and exemplary embodiment, an insulated container is provided. The insulated container includes a bottom, a peripheral wall, and a lid. The peripheral wall extends up from the bottom such that the bottom and the peripheral wall define an interior space of the container. The lid is pivotally attached to the peripheral wall. The lid is pivotable to a closed position engaging the peripheral wall to close the interior space. Where the lid is in the closed position, a difference of temperature is generally maintained between the interior space of the container and an exterior of the container. A vent passage extends through the peripheral wall or the lid. The vent passage communicates the interior space with the exterior of the container to prevent formation of a suction seal between the lid and the peripheral wall when the lid is engaging the peripheral wall in the closed position. A retaining frame is attached to the peripheral wall or the lid at a location on the peripheral wall or the lid corresponding to a location of the vent passage. An air-permeable, water-impermeable material layer blocks the vent passage to allow air flow through the vent passage while also preventing water from leaking out of the vent passage. The material layer is positioned between the retaining frame and the interior space of the container.

In one aspect according to the above-referenced embodiment, the container may further include a latch arm. The latch arm may be pivotably attached to the lid. The retaining frame may include a latch seat. The latch seat may be configured to be engaged by the latch arm when the lid is in the closed position.

In another aspect according to the above-referenced embodiment, the vent passage may extend through the peripheral wall. The latch arm may cover and conceal the vent passage and the material layer when the latch arm is engaged with the latch seat.

In another aspect according to the above-referenced embodiment, the vent passage may extend through the lid. The retaining frame may comprise a plate. The plate may be attached to the lid at a location corresponding to the location of the vent passage. And, the plate may cover and conceal the vent passage and the material layer.

In another aspect according to the above-referenced embodiment, the vent passage may be generally circularly shaped. The vent passage may have a diameter ranging from about 4 millimeters (mm) to about 6 millimeters (mm). The material layer may be generally circularly shaped, and the material layer may have a diameter greater than or equal to the diameter of the vent passage.

In another aspect according to the above-referenced embodiment, the vent passage may extend through the peripheral wall or the lid to define a length beginning from an exterior surface of the peripheral wall or the lid and ending at an interior surface of the peripheral wall or the lid. And, the material layer may be disposed within the vent passage length.

In another aspect according to the above-referenced embodiment, the material layer may comprise at least one of expanded polytetrafluoroethylene (ePTFE) or other air permeable-water impermeable materials, and combinations thereof.

In one particular and exemplary embodiment, a method of preventing a vacuum in a cooler and maintaining a temperature differential in the cooler is provided. The method commences with a step a) of providing a vent passage through an insulated peripheral wall or an insulated lid of the cooler. The peripheral wall extends up from a bottom of the cooler such that the bottom and the peripheral wall define an interior space of the cooler. The method continues with a step b) of blocking the vent passage with an air-permeable, water-impermeable material layer, thereby allowing air flow through the vent passage while preventing water from leaking out of the vent passage.

In one aspect according to the above-referenced embodiment, the material layer may comprise at least one of expanded polytetrafluoroethylene (ePTFE) or other suitable air permeable-water impermeable materials.

In another aspect according to the above-referenced embodiment, the step a) of the method may include concealing the vent passage behind a latch mounted on the peripheral wall such that when the latch is closed the vent passage is concealed from a user of the cooler.

Unless otherwise defined, all technical and scientific terms used herein have the same meaning as commonly understood by one of ordinary skill in the art to which this invention belongs. The present invention may be embodied in other specific forms without departing from the spirit or essential attributes thereof, and it is therefore desired that the present embodiment be considered in all aspects as illustrative and not restrictive. Any headings utilized in the description are for convenience only and no legal or limiting effect. Numerous objects, features, and advantages of the embodiments set forth herein will be readily apparent to those skilled in the art upon reading of the following disclosure when taken in conjunction with the accompanying drawings.

BRIEF DESCRIPTION OF THE DRAWINGS

Hereinafter, various exemplary embodiments of the disclosure are illustrated in more detail with reference to the drawings.

DETAILED DESCRIPTION

Figure 1A:
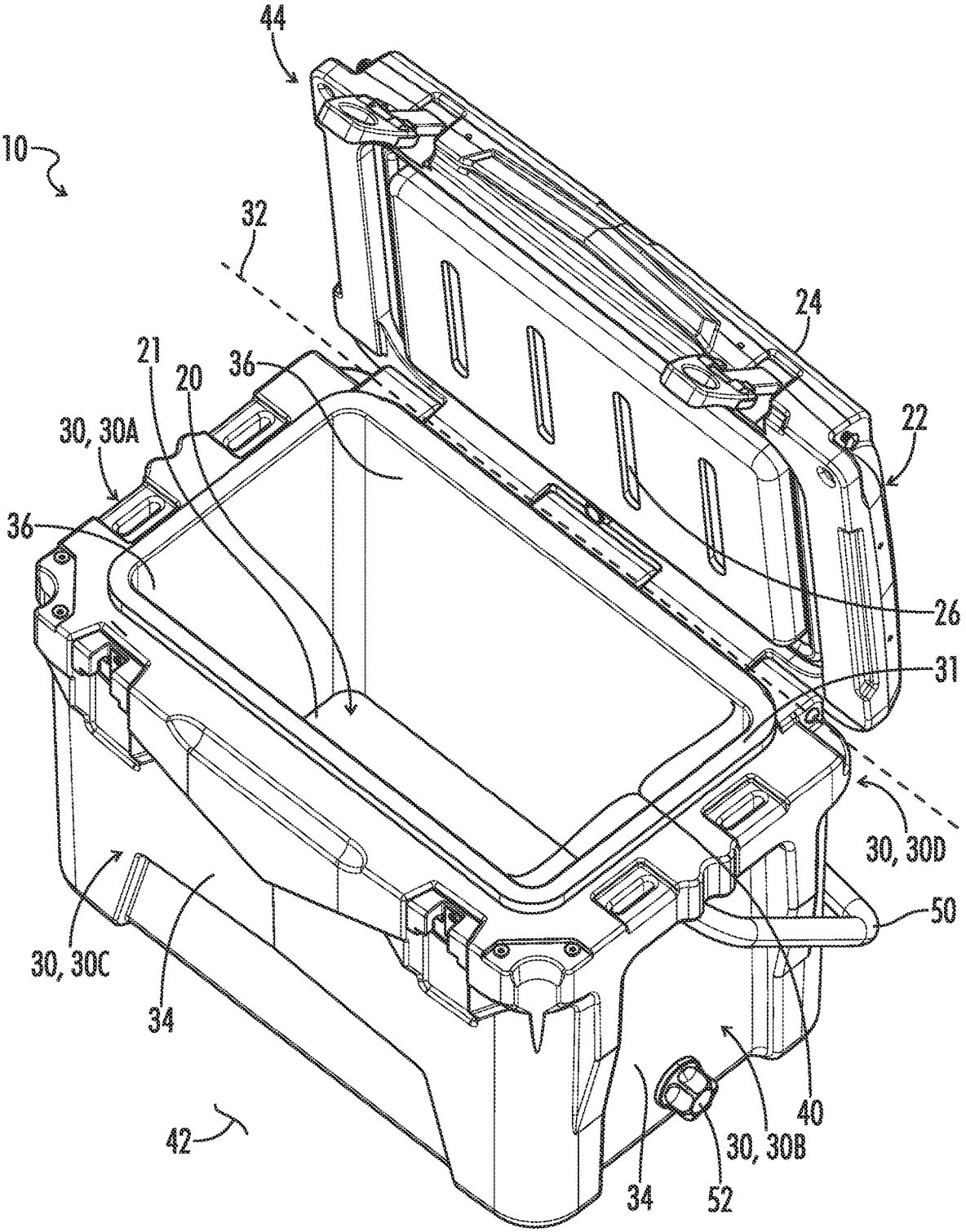
FIG. 1A is a perspective view of a first embodiment of an insulated cooler wherein a lid is pivoted to an open position.

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure. Referring generally to FIGS. 1A-5D, various exemplary embodiments may now be described of an insulated cooler 10, or an insulated container 10. Where the various figures describe embodiments sharing various common elements and features with other embodiments, similar elements and features are given the same reference numerals and redundant description thereof may be omitted below.

The words "connected," "attached," "joined," "mounted," "fastened," and the like, or any variation thereof, should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

The insulated cooler 10 may include an insulated bottom 20, an insulated lid 22, and an insulated peripheral wall 30. The peripheral wall 30 may include an insulated first sidewall 30A, an insulated second sidewall 30B, an insulated front wall 30C, and an insulated backwall 30D. For the purpose of this disclosure, when referring to the peripheral wall 30, the peripheral wall 30 may constitute any one or more of the first sidewall 30A, the second sidewall 30B, the front wall 30C, or the backwall 30D. The bottom 20 and peripheral wall 30 define an interior space 40 which may be closed by the lid 22. Exterior and interior surfaces of the peripheral wall 30, such as a peripheral wall exterior surface 34 or a peripheral wall interior surface 36, exterior and interior surfaces of the lid 22, such as a lid exterior surface 24 or a lid interior surface 26, or exterior and interior surfaces of the bottom 20, such as a bottom interior surface 21 or a bottom exterior surface (not depicted), may be rotomolded plastic and the walls may be as much as 3 inches thick filled with polyurethane foam insulation or other insulating materials understood in the art of insulated coolers.

The cooler 10 of the present disclosure may also include a cooler drain 52 disposed in the peripheral wall 30, as shown in FIGS. 1A-3D, 4A-5A, and 5C. The cooler drain 52 may be configured to release a liquid 14, such as water 14, residing within the interior space 40 of the cooler 10, in an amount regulable by the user of the cooler 10. For example, the user of the cooler 10 may optionally discard the liquid 14 in the interior space 40 of the cooler 10 by loosening the cooler drain 52 disposed in the peripheral wall 30, allowing the liquid 14 to escape the interior space 40 of the cooler 10.

Figure 1B:
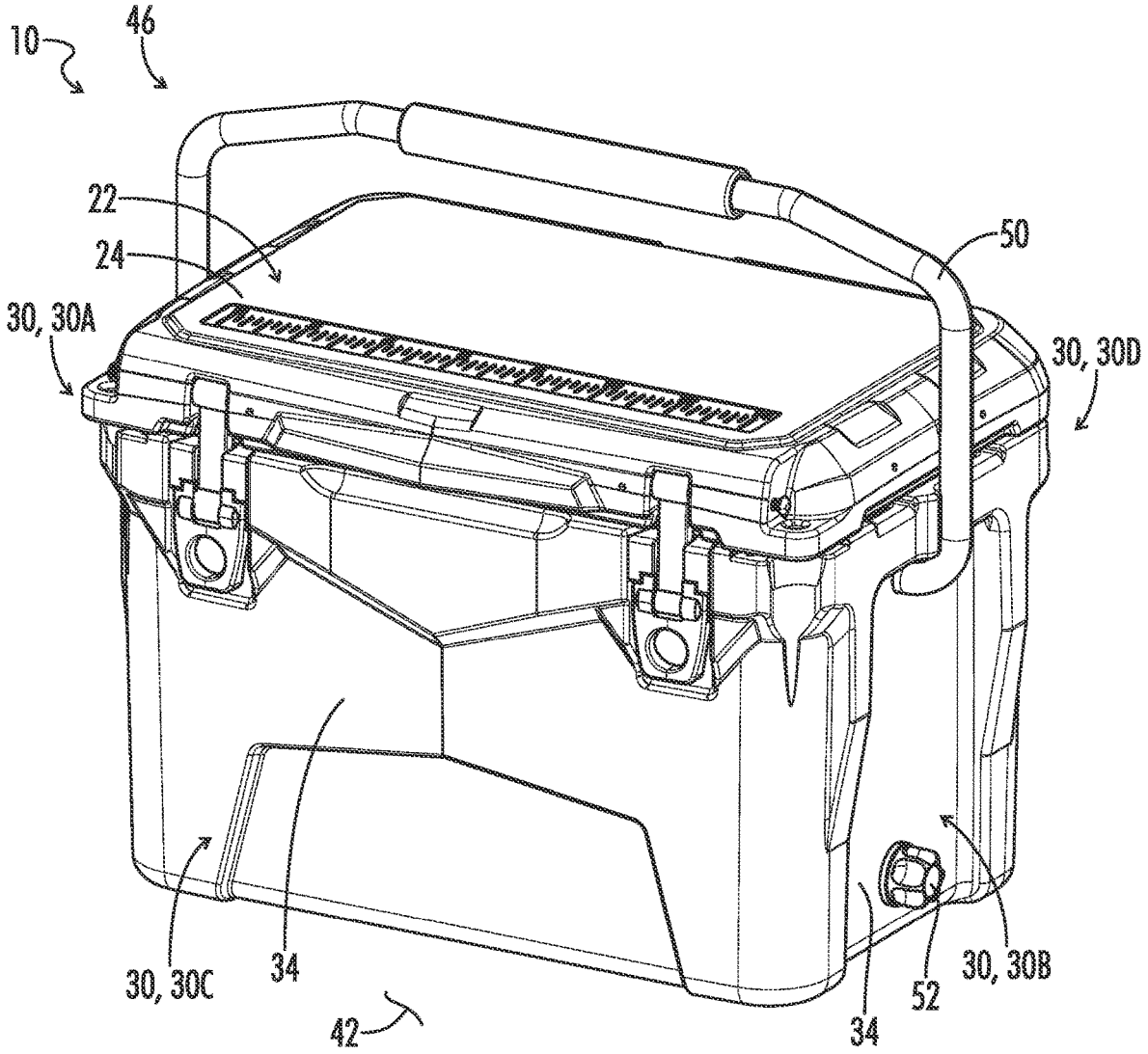
FIG. 1B is a perspective view of the insulated cooler of FIG. 1A having the lid pivoted to a closed position.

The lid 22 may be pivotally, or rotatably, attached to the peripheral wall 30, and the lid 22 may be pivotable, with respect to a pivot axis 32, between an open position 44, as shown in FIG. 1A, and a closed position 46, as shown in FIG. 1B. In the closed position 46, the lid 22 may be engaged to, or in contact with, the peripheral wall 30 to close the interior space 40. The lid 22 may be pivotally, or rotatably, attached to the backwall 30D. A high efficiency seal 31 is provided between the lid 22 and the peripheral wall 30. The interior space 40 may be configured to receive at least one thermally sensitive article, such as a food, a beverage, a drug, a medical supply, or another item capable of perishing, spoiling, deteriorating, or expiring when subjected to non-cooled, increased temperatures and transfers of heat.

In an absence of a vent passage 60 of the present disclosure (as further described below), where the lid 22 is in the closed position 46, a pressure differential may sometimes form between the interior space 40 of the cooler 40 and the exterior space 42. This pressure differential forms because cooled air in the interior space 40, which may be due to the presence of ice in the cooler 40 (or another cooling agent), causes the air enclosed within the cooler 10 to contract. This pressure differential provides a force holding the lid 22 in the closed position and makes it difficult for a user of the cooler 10 to open the lid 22.

Figure 2A:
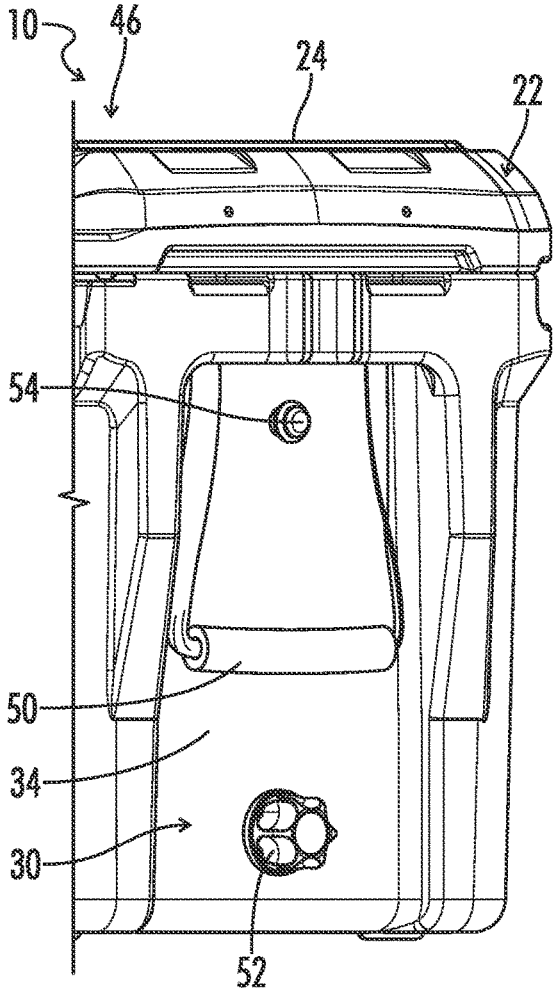
FIG. 2A is a perspective view of a prior-art insulated cooler having a pressure relief valve disposed in a peripheral wall of the cooler.
Figure 2B:
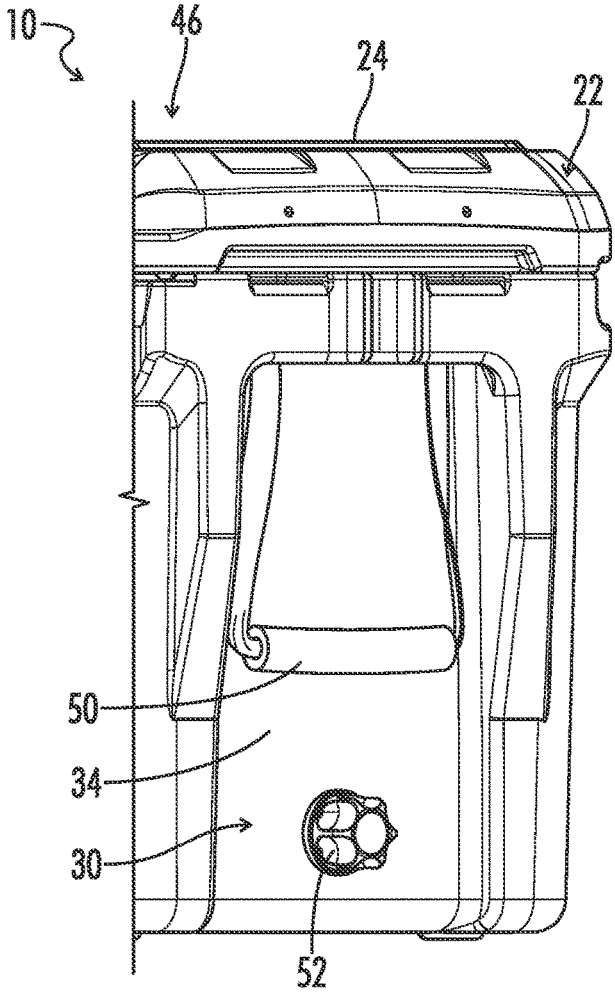
FIG. 2B is a perspective view of the insulated cooler of FIG. 1A, which does not have such a pressure relief valve, thus showing an improved aesthetic appearance of the insulated cooler.

Referring to FIGS. 2A-2B, a comparison is shown of a prior-art cooler 10 in FIG. 2A, which includes a vacuum release valve 54, and the cooler 10 of the present disclosure as seen in FIG. 2B which does not include a valve, such as the vacuum release valve 54. The vacuum release valve 54 of the prior art may be configured to neutralize the pressure differential so that the lid can be easily opened. The cooler 10 of the present disclosure, however, includes the vent passage 60 disposed in the peripheral wall 30 or the lid 22, the vent passage 60 of which prevents a formation of a pressure differential without the need for a valve or other constituent part, such as the vacuum release 54.

Referring to FIGS. 3A-3E, a perspective view of an embodiment of the cooler 10 is depicted, wherein a vent passage 60 is disposed in the peripheral wall 30, and the cooler 10 has a latch mechanism associated with the vent passage 60. The latch mechanism may include at least a latch 82 and a latch seat 90. In this example the vent passage 60 is located in the area of one or more of the latch mechanisms. There may be multiple latch mechanisms, each having a latch 82 that latch the lid 22 to the peripheral wall 30; for example, there may be a first latch 82A and a second latch 82B that latch the lid 22 to the peripheral wall 30. There may be multiple vent passages 60, such as a first vent passage 60A and a second vent passage 60B; for example, the first vent passage 60A can be located in an area of the first latch arm 82A, and the second vent passage 60B can be located in the area of the other latch—the second latch 82B. The vent passage 60 may be disposed in the peripheral wall 30, including by way of boring or otherwise forming a hole or an opening through the peripheral wall 30. The vent passage 60 may extend through the peripheral wall 30 from the peripheral wall exterior surface 34 to the peripheral wall interior surface 36, so as to communicate atmospheric conditions of the interior space 40 of the cooler 10 with the exterior space 42. In communicating the atmospheric conditions of the interior space 40 of the cooler 10 with the exterior space 42, the vent passage 60 may prevent a formation of the vacuum in the interior space 40 of the cooler 10 when the lid 22 is in the closed position 46. By preventing the formation of the vacuum in the interior space 40 of the cooler 10, the problem encountered in the prior art of difficulty in opening the lid 22 of the cooler 10 is eliminated.

Figure 3A:
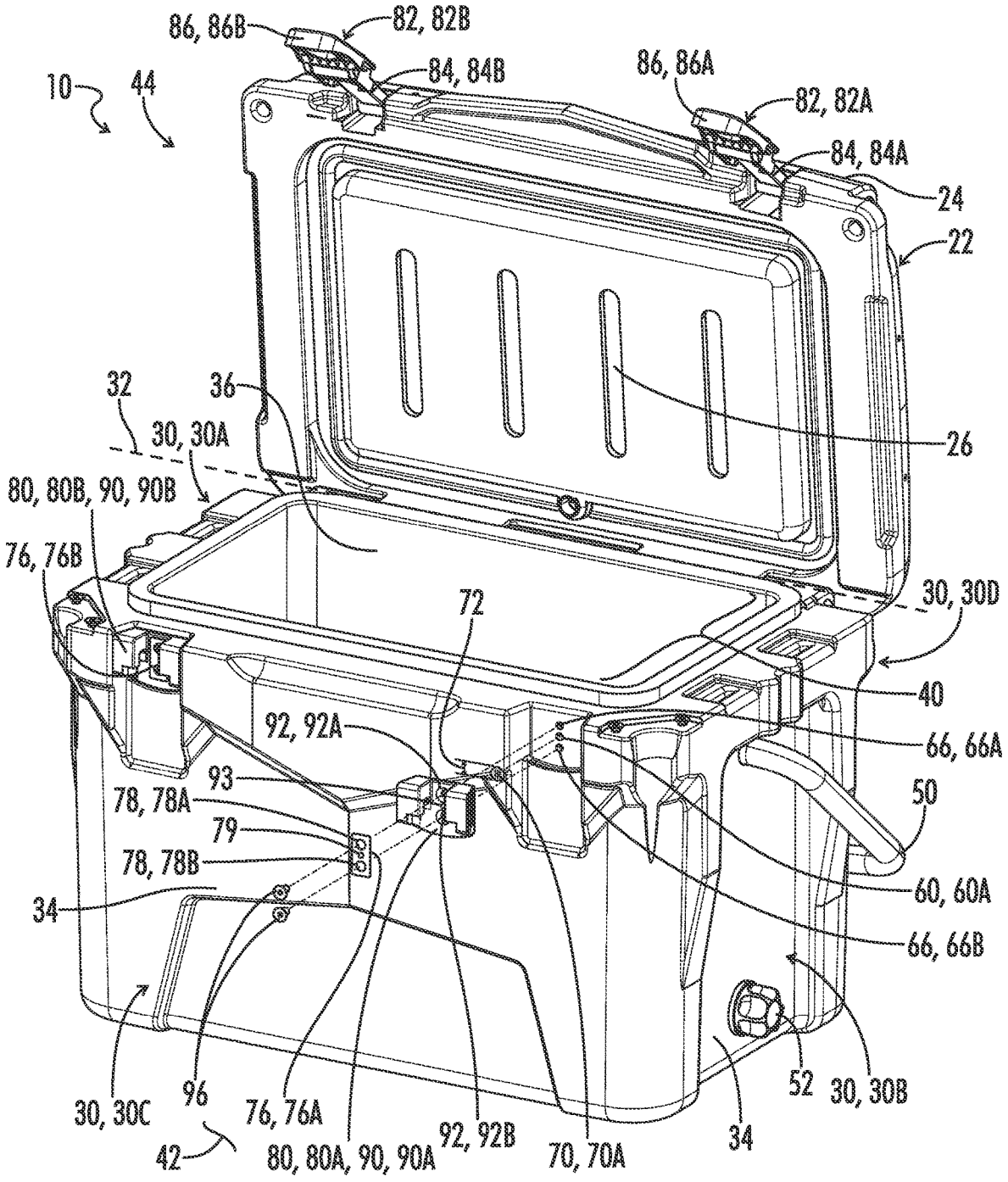
FIG. 3A is a perspective view of the cooler of FIG. 1A showing components of a latch assembly and a vent arrangement in an exploded view.
Figure 3B:
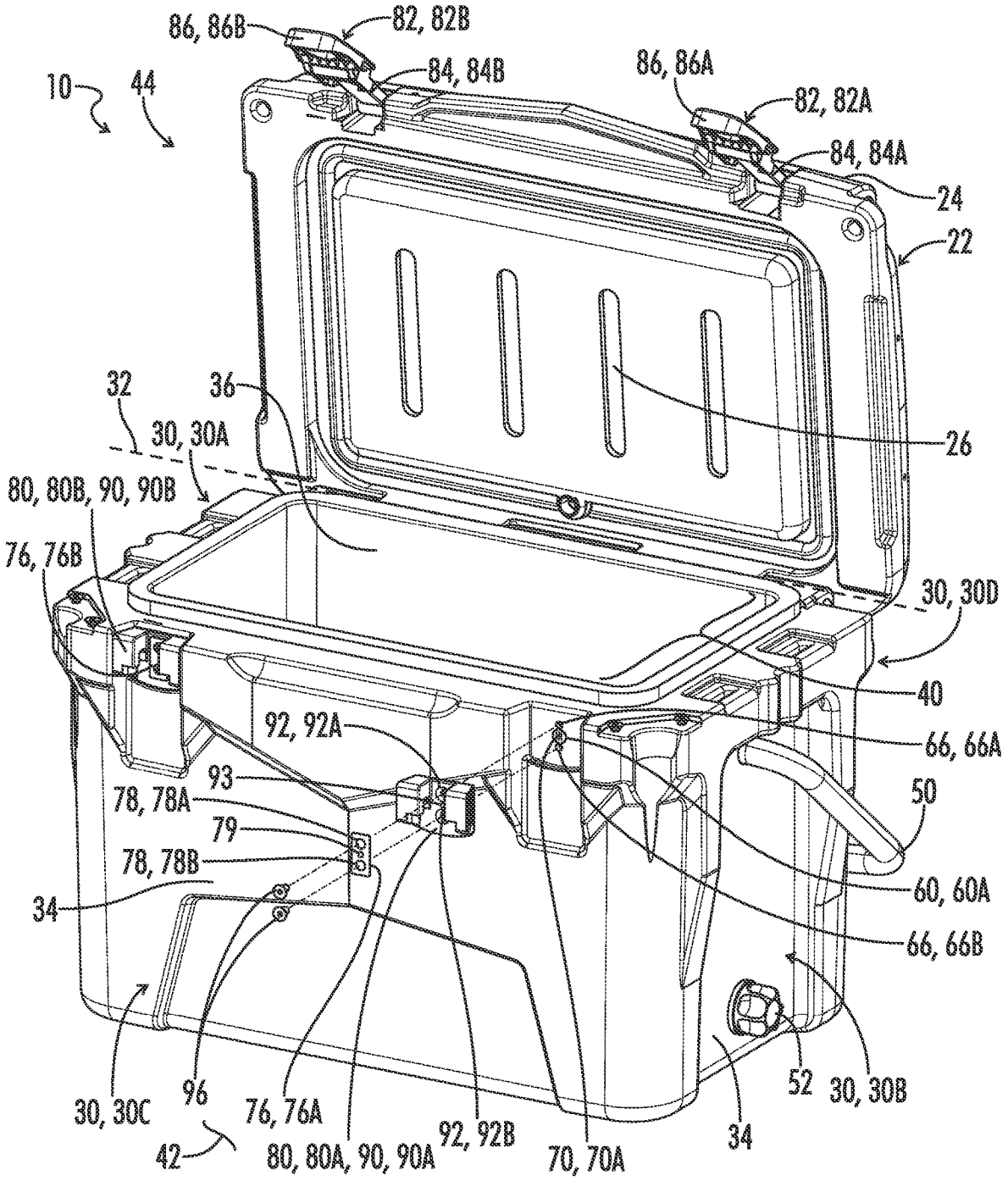
FIG. 3B is a perspective view similar to FIG. 3A, but showing a layer of air-permeable, water-impermeable material in place over a vent passage.
Figure 3C:
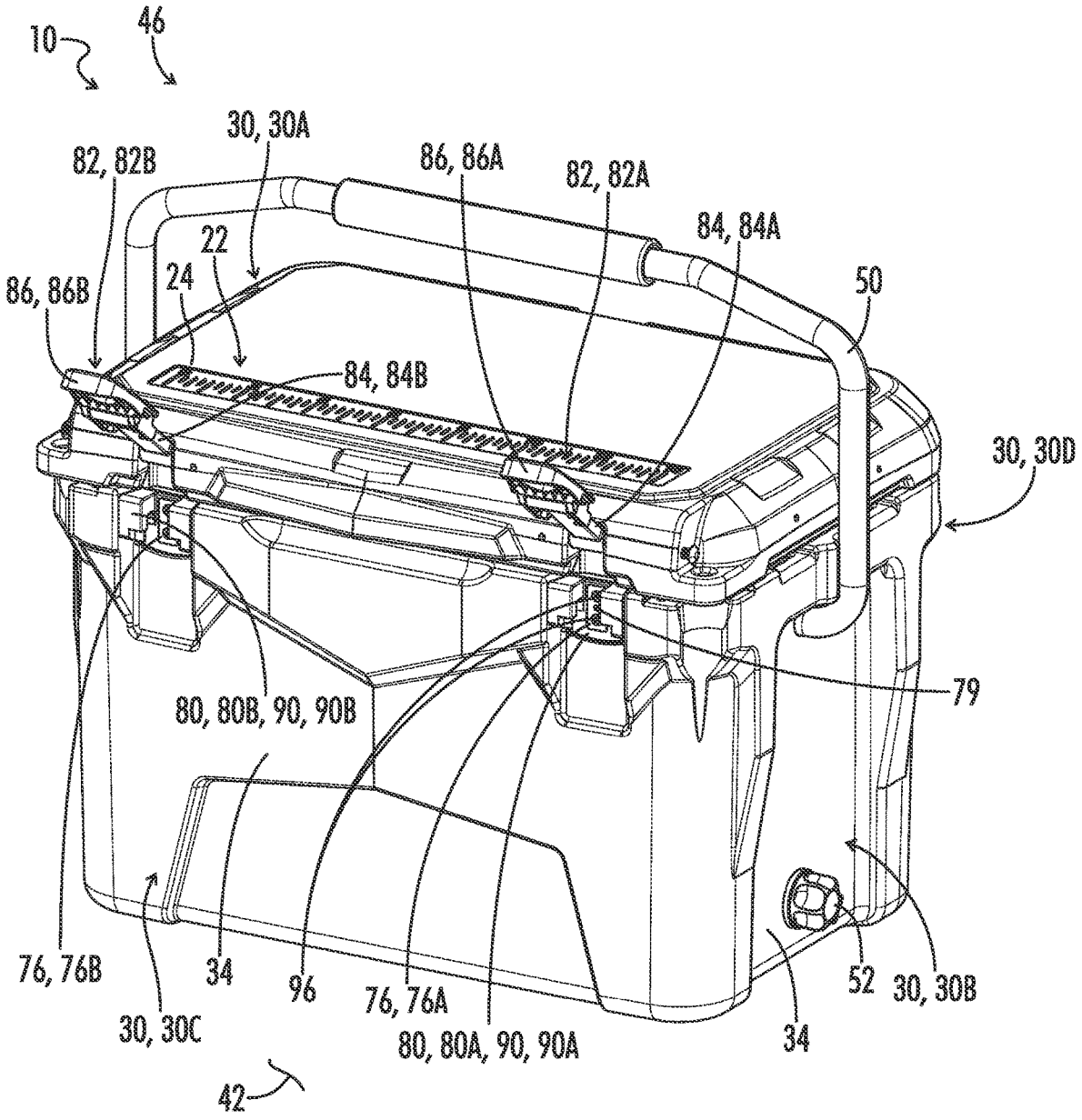
FIG. 3C is a perspective view similar to FIGS. 3A and 3B, but showing the latch assembly and the vent arrangement assembled.
Figure 3D:
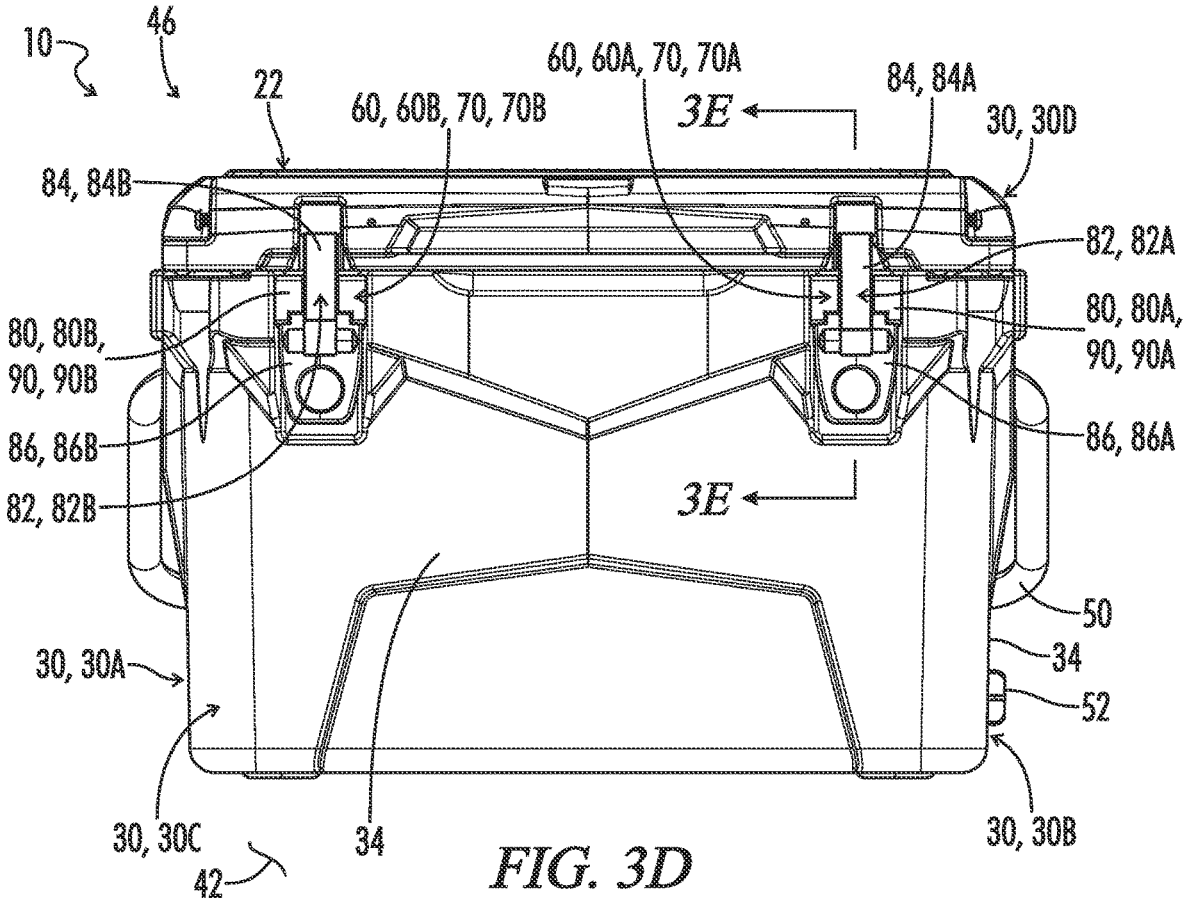
FIG. 3D is a front-elevation view of the cooler of FIG. 1A, showing the lid in the closed position with latches of the latch assembly securing the lid to the closed position.
Figure 3E:
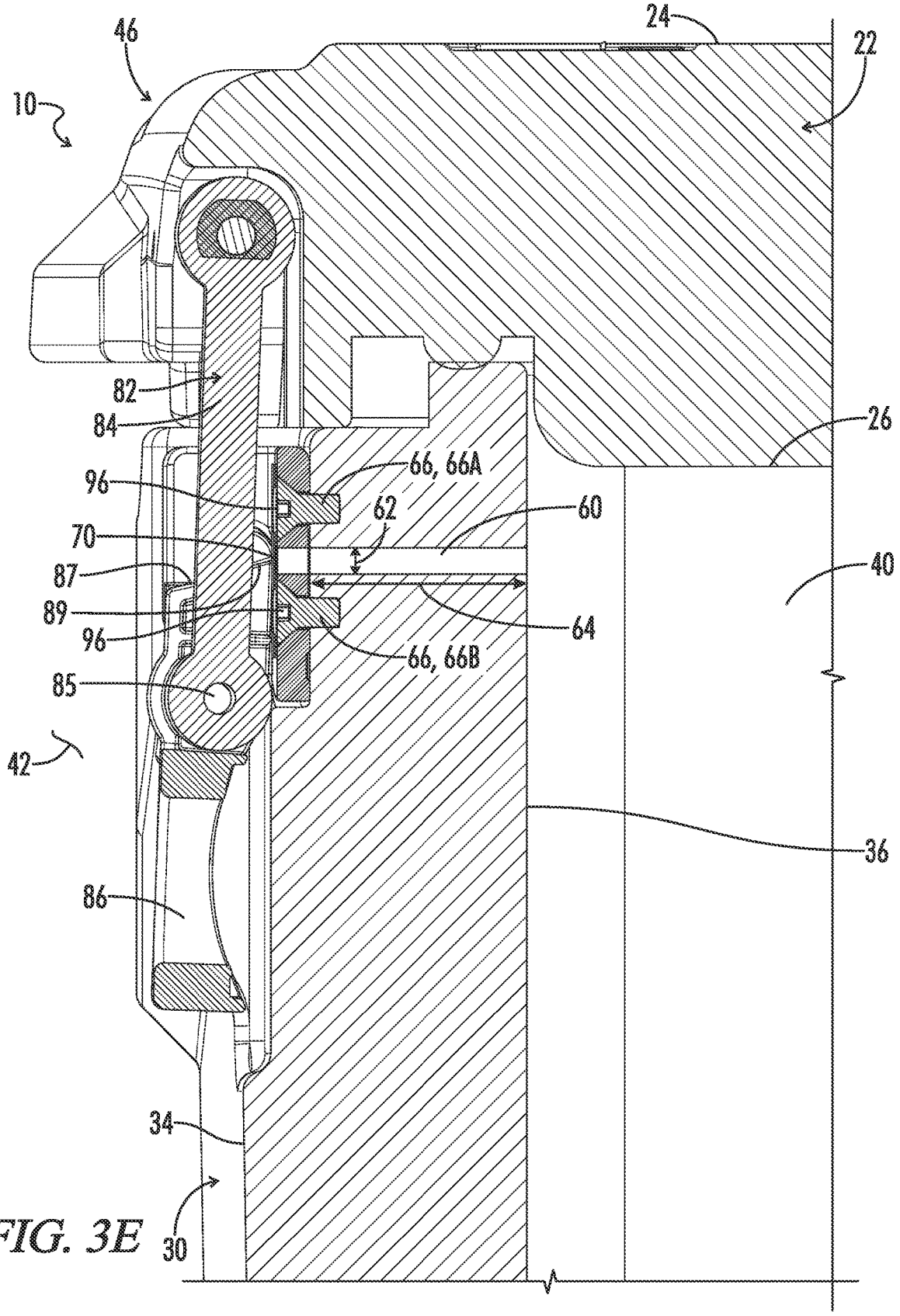
FIG. 3E is a cross-section view taken along line 3E-3E of FIG. 3D showing the details associated with the vent passage through a front wall of the cooler, and the details of the latch assembly.

Referring to FIG. 3E, a cross-section view taken along line 3E-3E of FIG. 3D shows the details of the vent passage 60 and the associated latch mechanism. The vent passage 60 has a vent passage length 64 extending from the peripheral wall exterior surface 34 to the peripheral wall interior surface 36. The vent passage 60 may be generally circularly shaped, as evidenced by a cross-sectional area on the vent passage length 64, though the vent passage 60 may be shaped in any other geometrical configuration. To the extent the vent passage 60 is generally circularly shaped, the vent passage 60 may have a vent passage diameter 62. The vent passage diameter 62 may range from about 3 mm to about 6 mm, and more preferably in a range of from about 2 mm to about 4 mm. Such a vent passage 60 having relatively small dimensions allows pressure equalization between the interior space 40 and the exterior space 42 of the cooler 10 without allowing any significant volumetric flow of air from the exterior space 42 into the cooler 10 so as to significantly decrease the cooling efficiency of the cooler 10.

Referring to FIGS. 3A-3E, a retaining frame 80 may be attached to the peripheral wall 30 at a location on the peripheral wall 30 corresponding to a location of the vent passage 60. The retaining frame 80 may include one or more retaining frames 80, such as a first retaining frame 80A and a second retaining frame 80B. The retaining frame 80 may comprise, or otherwise constitute, the latch seat 90 of the latch mechanism. The latch seat 90 may include one or more latch seats 90, such as a first latch seat 90A and a second latch seat 90B, as shown in FIGS. 3A-3E.

In the embodiment illustrated in FIGS. 3A-3E, there are two latches 82A and 82B. Each latch 82 may have a latch arm 84 and a latch handle 86. The latch arm 84 of the latch 82 may be pivotably or rotatably supported from, or attached to, the lid 22. The latch arm 84 may include one or more latch arms 84, such as a first latch arm 84A, which is associated with the first latch 82A, and a second latch arm 84B, which is associated with the second latch 82B. The latch arm 84 may terminate at an end defined by a latch handle 86, the latch handle 86 of which may be pivotably or rotatably supported from, or attached to, the latch arm 84. The latch handle 86 may include one or more latch handles 86, such as a first latch handle 86A associated with the first latch 82A, and a second latch handle 86B, which is associated with the second latch 82B. The latch handle 86 may be configured to be gripped or grabbed by the user of the cooler 10. The latch handle 86 may be a t-shaped handle, a quick-release latch handle, a swing-up handle, or other latch handle as understood in the art of embodiments of the cooler 10.

As best seen in FIG. 3E the latch handle 86 is pivotally attached to the latch arm 84 at pivot pin 85. The latch handle 86 has a wedge shaped upper surface 87 which in the latched position is received under a complementary wedge shaped undercut 89 of the latch seat 90. The latch arm 84, latch handle 86 and latch seat 90 are configured such that when the wedge shaped upper surface 87 is engaged with the wedge shaped undercut 89 and the latch handle 86 is pressed toward the front wall 30C the latch snaps into and is resiliently retained in the latched position shown in FIG. 3E. When the latch is in the latched position the vent passage 60 is hidden behind the latch arm 84.

Figure 5A:
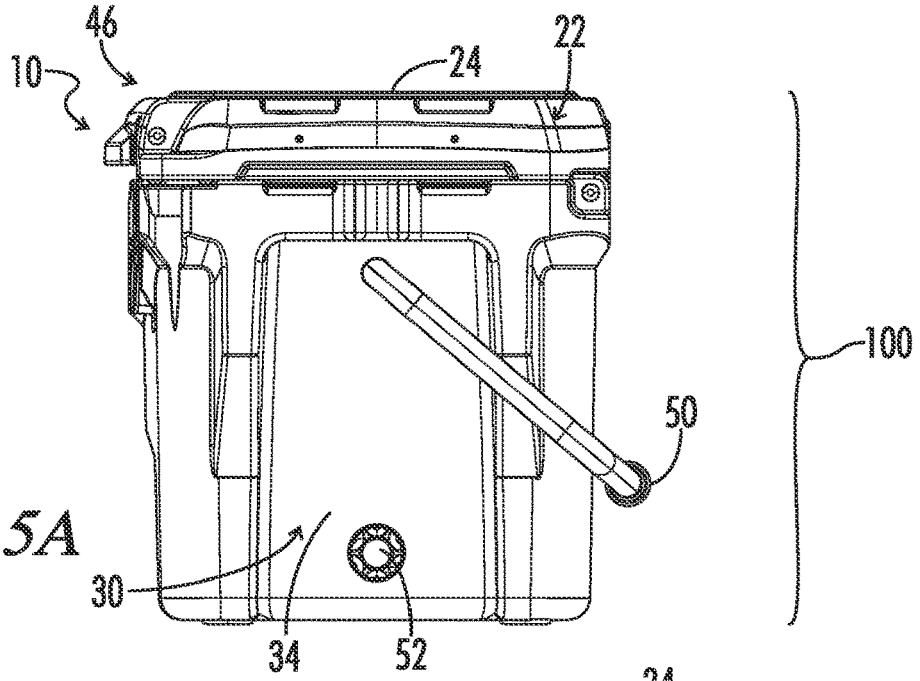
FIG. 5A is a right-side elevation view of the cooler of FIG. 1A.
Figure 5B:
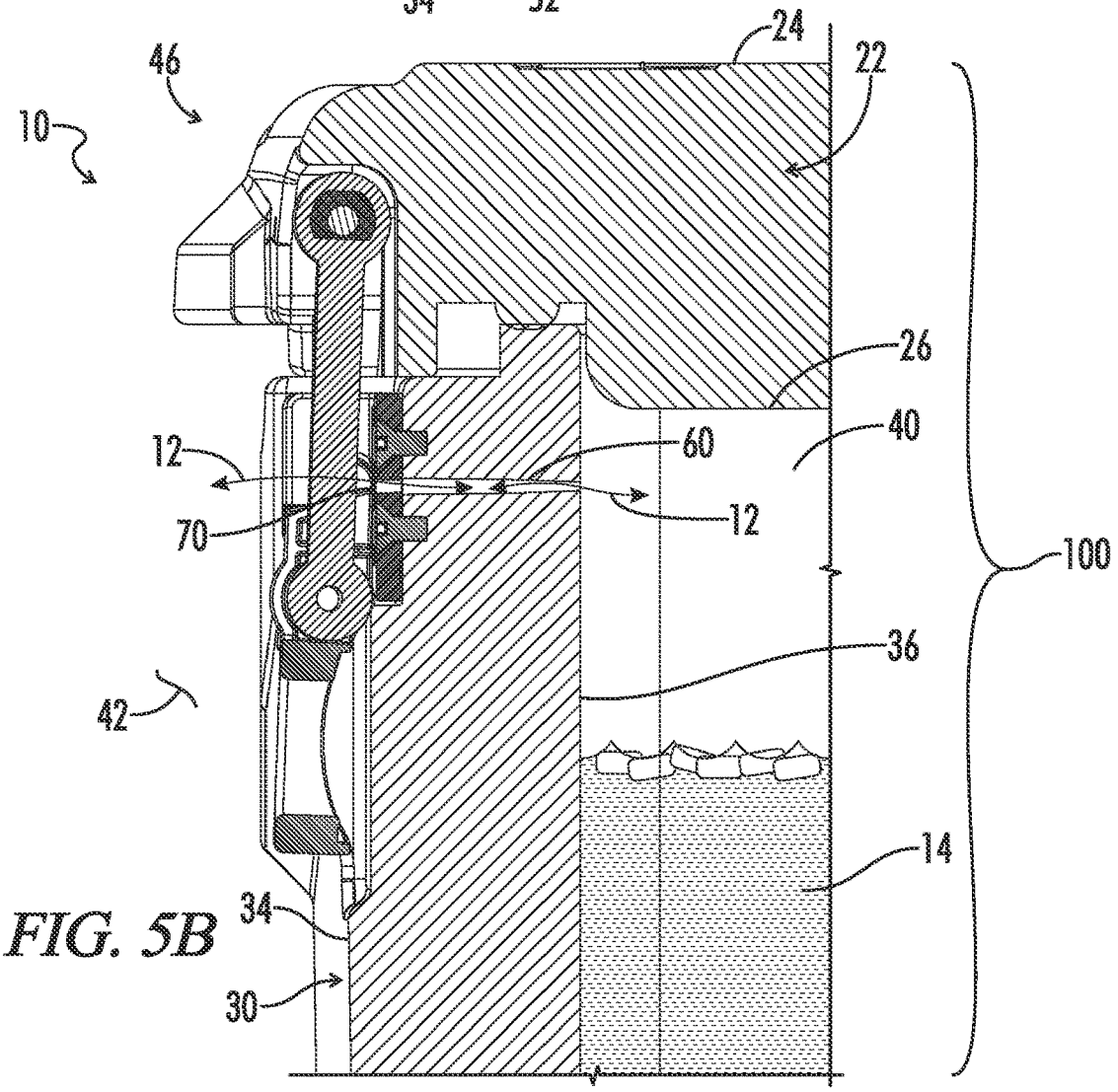
FIG. 5B is a cross-section view similar to FIG. 3E, but additionally illustrating the problem of dealing with water within an interior space of the cooler.

Referring to FIGS. 3A-3E, an air-permeable, water-impermeable material layer 70 may be placed adjacent to, in front of, in contact with, or against the vent passage 60, such that the material layer 70 blocks the vent passage 60. Alternatively, the material layer 70 may be placed within the passage 60. The material layer 70 may include one or more material layers 70, such as a first material layer 70A, which is associated with the first vent passage 60A, and a second material layer 70B, which is associated with the second vent passage 60B. Because the material layer 70 is air-permeable and water-impermeable, the material layer 70 may allow an air flow 12 through the vent passage 60 from the exterior space 42 to the interior space 40 of the cooler 10 (and vice versa), as shown in FIGS. 5A-5B, and the material layer 70 may prevent, or deter, the liquid 14, such as water 14, from escaping, exiting, or leaking out of the vent passage 60 from the interior space 40 of the cooler 10 to the exterior space 42. One suitable air-permeable and water-impermeable material is expanded polytetrafluoroethylene (ePTFE), though the material layer 70 may be made of another air-permeable, water-impermeable material. By covering the vent passage 60 with the material layer 70, the liquid 14 may not escape or leak out of the interior space 40 of the cooler 10.

The material layer 70 may be generally circularly shaped, though the material layer 70 may be shaped in any other geometrical configuration. To the extent the material layer 70 is generally circularly shaped, the material layer 70 may have a material layer diameter 72. The material layer diameter 72 may be greater than or equal to the vent passage diameter 62. The material layer 70, which may constitute a membrane or a thin film, may have a thickness ranging from ranging from about 0.1 mm to about 0.3 mm. The material layer 70 may be attached or adhered to the peripheral wall exterior surface 34 adjacent to, in front of, in contact with, or against the vent passage 60, thereby blocking the vent passage 60

Alternatively, the material layer 70 may be disposed within the vent passage 60. For example, the material layer 70 may be disposed at any location along the vent passage length 64, thereby blocking the vent passage 60. The material layer 70 may be disposed within the vent passage 60 extending through the peripheral wall 30 as shown in FIGS. 3A-3D or within the vent passage 60 extending through the lid 22 as shown in FIGS. 4A-4B.

Referring to FIGS. 3A-3E, the retaining frame 80, such as the latch seat 90, may be attached to the peripheral wall 30 at a location on the peripheral wall 30 corresponding to a location of the vent passage 60 extending through the peripheral wall 30. The material layer 70, which blocks the vent passage 60, may be placed or positioned between the retaining frame 80 and the interior space 40 of the cooler 10. Alternatively, the retaining frame 80 may be attached to the peripheral wall 30 to hold the material layer 70 in place. The retaining frame 80 may hold the material layer 70 in place relative to the vent passage 60, as shown in FIGS. 3A-3B. To attach the retaining frame 80—the latch seat 90—to the peripheral wall 30 at the location on the peripheral wall 30 corresponding to the location of the vent passage 60, one or more fastener holes 66A and 66B may be formed in the peripheral wall 30 proximate to the vent passage 60.

To assemble the latch mechanism, which includes at least the latch 82 and the latch seat 90, and the vent arrangement, which includes at least the vent passage 60 and the material layer 70, as illustrated in the series of FIGS. 3A-3C, the material layer 70 is placed over an end of the vent passage 60. The latch seat 90 is then placed over the material layer 70 such that fastener holes 92, such as a first fastener hole 92A and a second fastener hole 92B, are aligned with the fastener holes 66A and 66B, respectively. A support member 76 may be placed over the latch seat 90 so that fastener holes 78A and 78B are aligned with the fastener holes 92A and 92B of the latch seat 90, and then two fasteners or screws 96 are threaded into the aligned fastener holes 78A and 92A, and 78B and 92B, to hold the latch 82 in place on the front wall 30C of the cooler 10. The latch seat 90 may include a latch seat vent hole 93, and the support member 76 may also include a support member vent hole 79. The latch seat vent hole 93 and the support member vent hole 79 may be aligned with the end of the vent passage 60. The engagement of the latch arm 84 to the latch seat 90, as shown in FIGS. 3C-3E and previously described herein, may cover and conceal the vent passage 60 and the material layer 70 from the user of the cooler 10. By covering and concealing the vent passage 60 and the material layer 70, an aesthetic value of the cooler 10 is bolstered or maintained, at least in part because the vent passage 60 and the material layer 70 are hidden in customary constituent parts of the cooler 10, such as the latch mechanism.

Figure 4A:
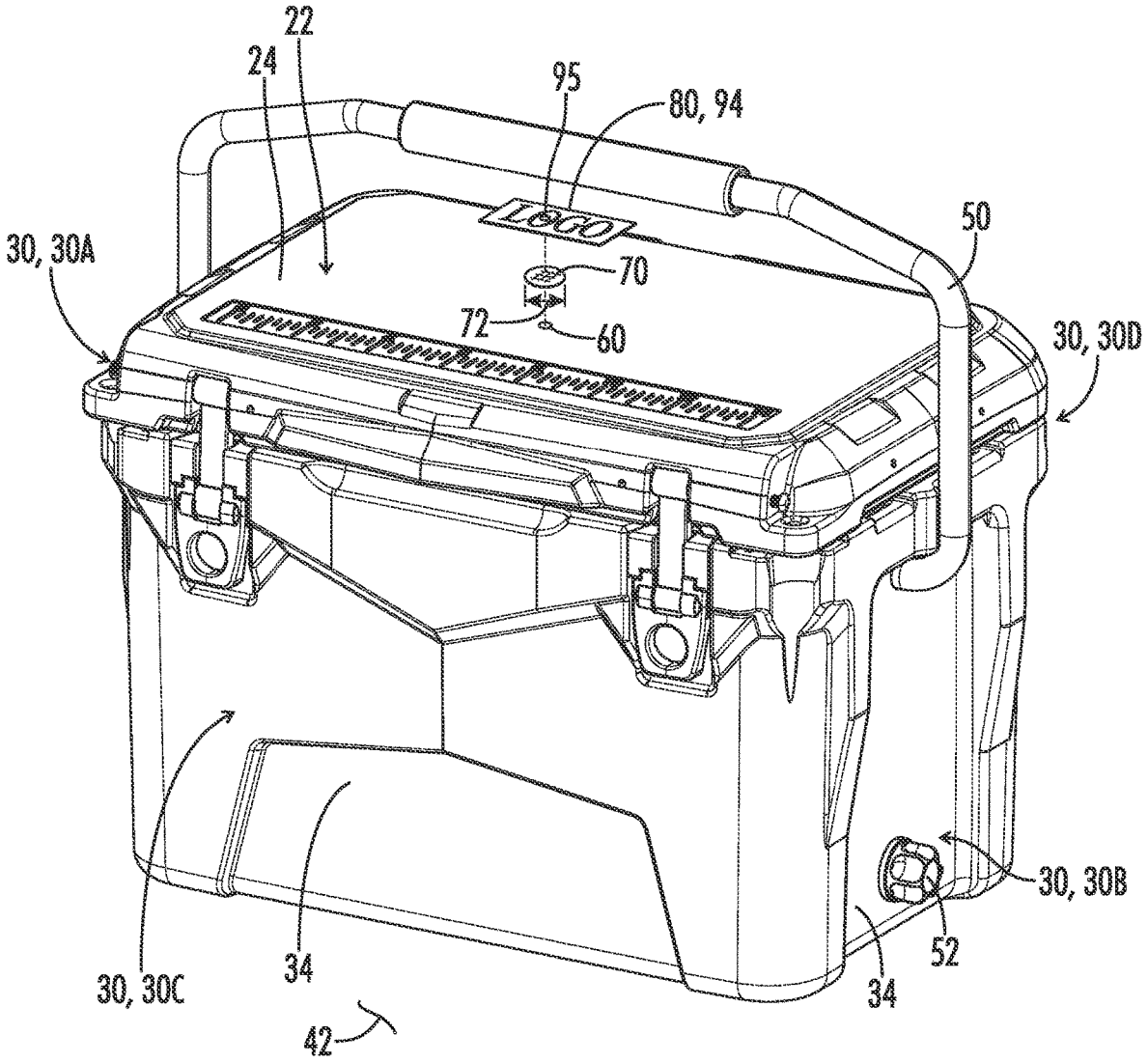
FIG. 4A is a perspective view of a second embodiment of a cooler, which in this embodiment has a vent passage through the lid of the cooler and hidden under a logo plate of the cooler. In this view the layer of air-permeable, water-impermeable material and the logo plate are shown in an exploded view.
Figure 4B:
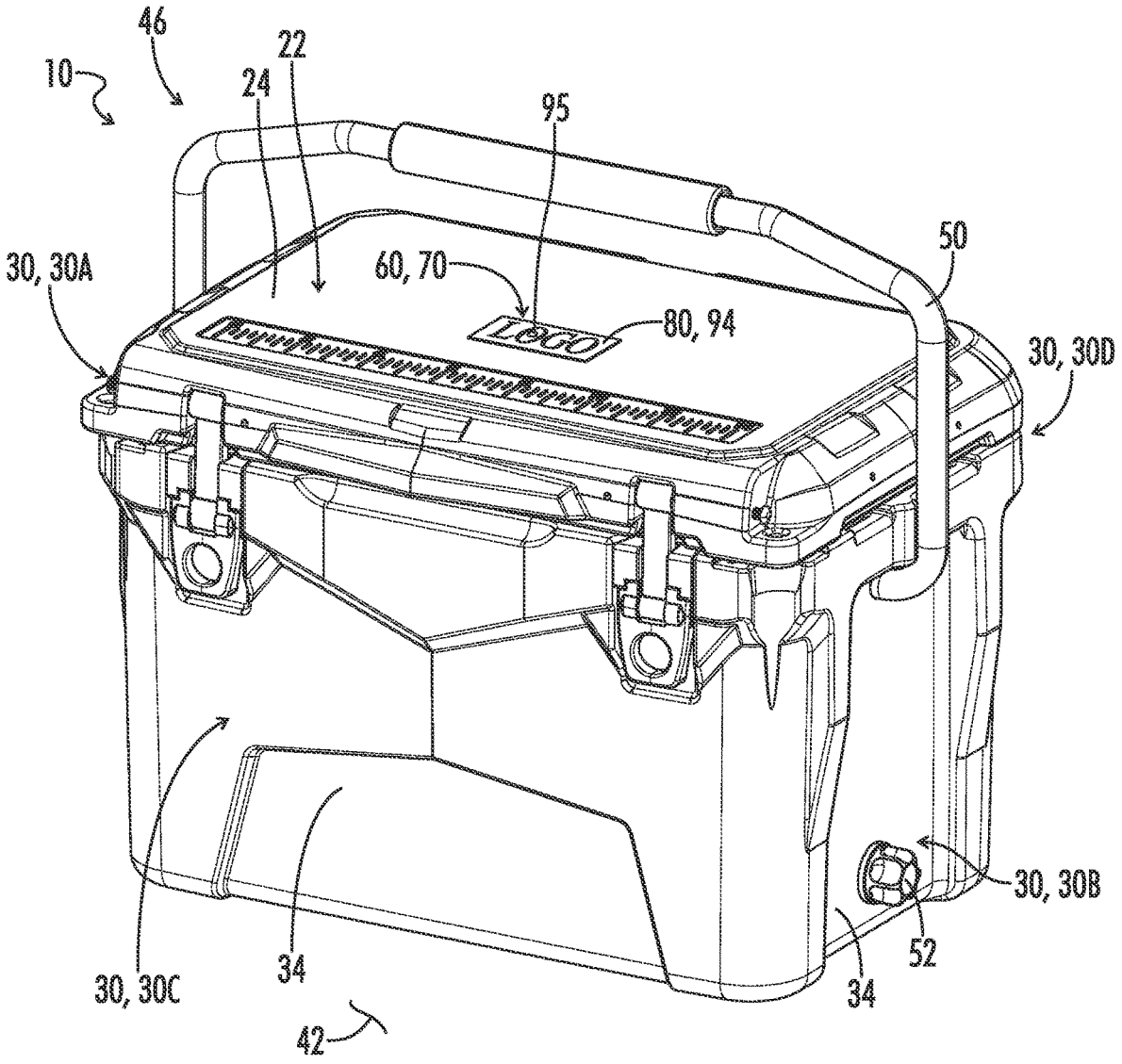
FIG. 4B is a perspective view of the embodiment of FIG. 4A showing the vent arrangement assembled on top of the lid.

Referring to FIGS. 4A-4B, an alternative embodiment of the cooler 10 is shown wherein the vent passage 60 is disposed in the lid 22 instead of through the peripheral wall 30. The vent passage 60 may extend through the lid 22 from the lid exterior surface 24 to the lid interior surface 26, so as to communicate atmospheric conditions of the interior space 40 of the cooler 10 with the exterior space 42. The retaining frame 80 may comprise, or otherwise constitute, a plate 94 or another longitudinal member, which may for example be a logo plate 94 as is often included on the cooler 10. The plate 94 may be attached to the lid 22 at a location corresponding to a location of the vent passage 60 extending through the lid 22. The plate 94 may be attached to or adhered to the lid 22 to hold the material layer 70 in place relative to the vent passage 60 extending through the lid 22. The plate 94 may have a logo, insignia, or mark inscribed, written, or sketched thereon. The plate 94 may have a plate opening 95 overlying the end of the passage 60 to allow free communication with air residing in the exterior space 42. In general, the plate 94 overlies and conceals the vent passage 60 and the material layer 70, and the plate 94 holds the material layer 70 in place.

In other embodiments of the cooler 10, the vent passage 60 may be covered and concealed by other customary constituent parts of an embodiment of the cooler 10. For example, in some embodiments, the vent passage 60 may be disposed in the peripheral wall 30 at a location behind or proximate to where a handle 50 is attached to, or supported from, the peripheral wall 30 of the cooler 10. The handle 50 may be attached to, or supported from, the peripheral wall 30, such that the user of the cooler 10 can move, lift, carry, or otherwise manipulate the cooler 10. The handle 50 may constitute any one or more of embodiments of the handle 50 disclosed herein, including the handle 50 that rotates about, or pivots relative to, the peripheral wall 30 such that the handle 50 may be gripped or grabbed by the user atop the lid 22, as shown in FIGS. 1A-1B, 3A-3D, 4A-4B, 5A, and 5C, as well as the handle 50 that rotates or pivots away from the peripheral wall 30, such that the handle 50 may be gripped or grabbed by the user proximate to the peripheral wall 30, as shown in FIGS. 2A-2B.

Figure 5C:
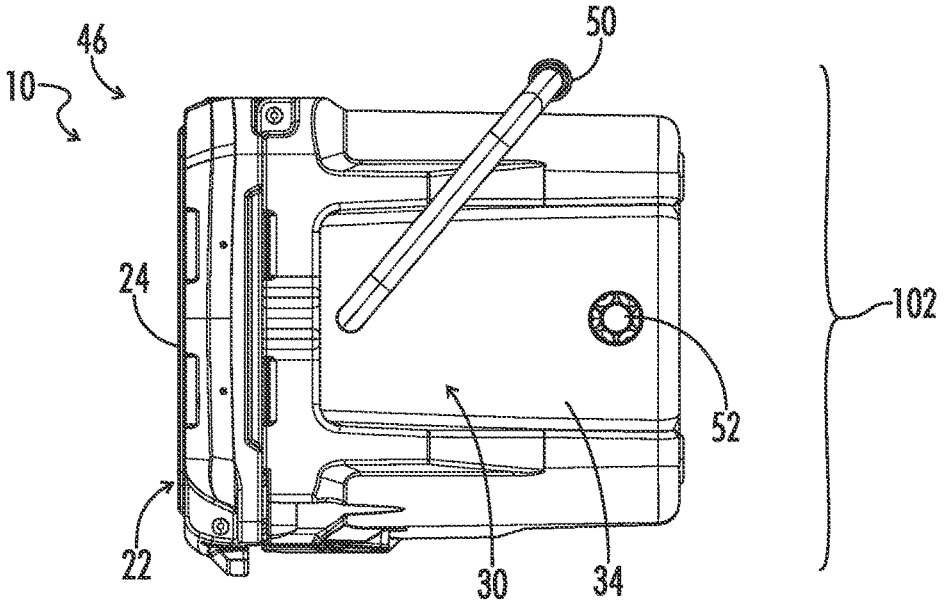
FIG. 5C shows the cooler of FIG. 5A laid on the cooler's front side.
Figure 5D:
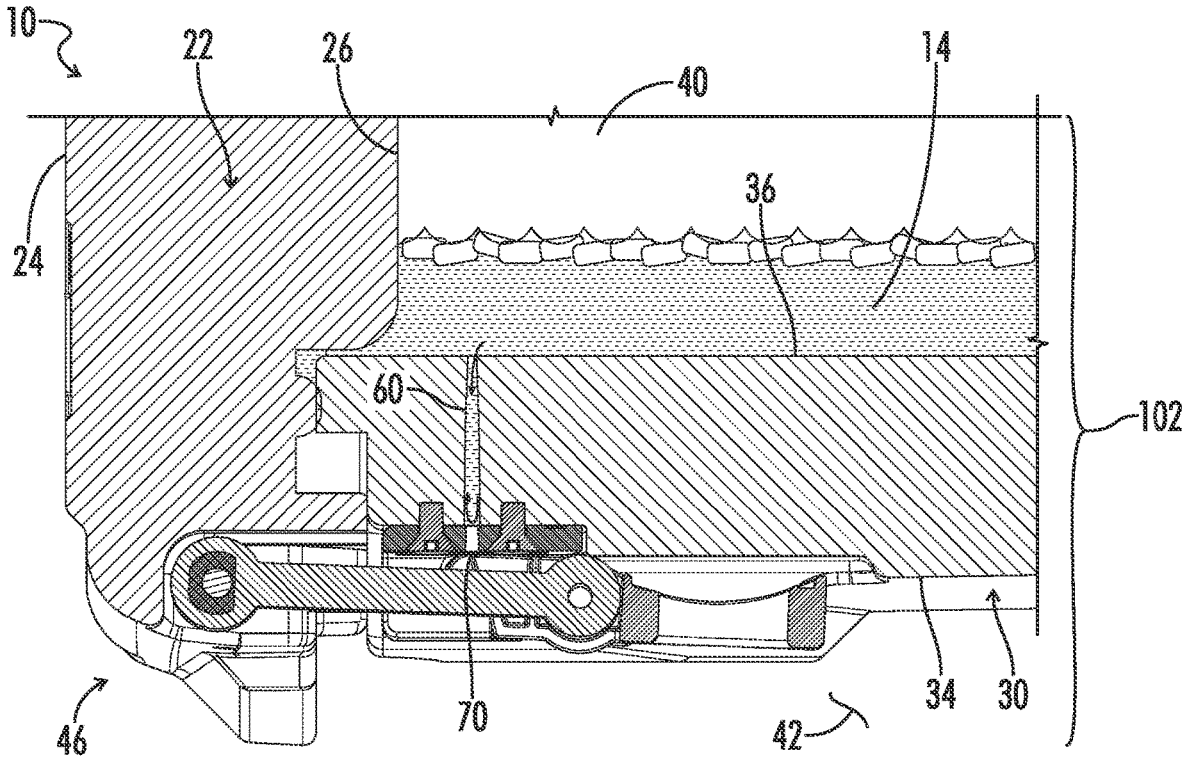
FIG. 5D is a cross-section again similar to FIG. 3E and FIG. 5B, but with the cooler laid on its front side as in FIG. 5C to illustrate the solution to the potential problem of water leakage through the vent passage.

Referring to FIG. 5A5B a right-side elevation view of the cooler 10 is depicted, wherein the cooler 10 is an upright configuration 100. In FIGS. 5C-5D, the cooler 10 is shown laying on its front wall 30C in a rotated configuration 102. The upright configuration 100 constitutes any configuration where the cooler 10 sits or resides atop a surface, such that the bottom 20, in whole (or substantially in whole) is in contact with the surface. The rotated configuration 102 constitutes any configuration where the cooler 10 does not sit atop the surface, whether because the bottom 20 is only in contact with the surface in part, or the cooler 10 is tipped over, such that the peripheral wall 30 or the lid 22, in whole or in part, is in contact with the surface. The rotated configuration 102 may be caused from transporting, carrying, moving, or otherwise manipulating the cooler 10. As shown in FIGS. 5A-5B, the vent passage 60, and the material layer 70 blocking the vent passage 60, may communicate the atmospheric conditions of the interior space 40 of the cooler 10 with the atmospheric conditions of the exterior space 42. The atmospheric conditions are communicated by and through an exchange, or transfer, of the air flow 12 through the vent passage 60 from the interior space 40 of the cooler 10 to the exterior space 42, and vice versa. By communicating the atmospheric conditions, the vacuum is prevented from forming in the interior space 40 of the cooler 10. In enabling an exchange or the transfer of the air flow 12, however, the vent passage 60 presents the risk, or possibility, of the liquid 14 escaping or exiting from, or leaking out of, the cooler 10 through the vent passage 60, especially where the cooler 10 is moved to the rotated configuration 102. The air-permeable, water-impermeable material layer 70 blocking the vent passage 60 prevents the liquid 14 from escaping or exiting from, or leaking out of, the cooler 10 through the vent passage 60, as shown in FIGS. 5C-5D. Thus, the vent passage 60, coupled with the material layer 70, serve at least a dual function: to allow a transfer or the exchange of the air flow 12 through the vent passage 60 from the interior space 40 of the cooler 10 to the exterior space 42, and vice versa, so as to prevent formation of the vacuum in the interior space 40 of the cooler 10; and to prevent the water 14, or the other liquified contents 14, from inadvertently or undesirably leaking out of the cooler 10 when moving the cooler 10 from the upright configuration 100 to the rotated configuration 102.

A method of preventing formation of a vacuum in the cooler 10 and maintaining a temperature differential in the cooler 10 may be described as follows. The method may commence with a step a) of providing the vent passage 60 through the peripheral wall 30 or the lid 22. The vent passage 60 may be provided through the peripheral wall 30 or the lid 22. The step a) of providing the vent passage 60 through the peripheral wall 30 or the lid 22 enables communication of the atmospheric conditions of the exterior space 42 with the atmospheric conditions of the interior space 40 of the cooler 10, thereby preventing a formation of the vacuum in the interior space 40 of the cooler 10. In optional embodiments, where the vent passage 60 extends through the peripheral wall 30, the step a) may further include covering and concealing the vent passage 60 behind the latch 82 mounted or supported from the peripheral wall 30 or the lid 22, where the latch seat 90 receives and secures the latch arm 84 when the lid 22 is pivoted to the closed position 46. In other optional embodiments, where the vent passage 60 extends through the lid 22, the step a) may further include covering and concealing the vent passage 60 behind the plate 94 attached to the lid 22. The method may continue with a step b) of blocking the vent passage 60 with the air-permeable, water-impermeable material layer 70. By blocking the vent passage 60 with the material layer 70, the air flow 12 may be allowed to transfer or exchange through the vent passage 60 from the interior space 40 of the cooler 10 to the exterior space 42, and vice versa. And further, by blocking the vent passage 60 with the material layer 70, the water 14, or the other liquified contents 14, may be prevented from escaping, exiting, or otherwise leaking out of the cooler 10 through the vent passage 60. Through performance of the step a) and the step b) of the method, at least a dual function is achieved: first, the vacuum is prevented from forming in the interior space 40 of the cooler 10, thereby preventing the formation of a pressure differential holding the lid 22 in the closed position 46; and, second, the water 14, or the other liquified contents 14, are prevented from inadvertently or undesirably exiting, escaping, or otherwise leaking out of the cooler 10 through the vent passage 60 when moving the cooler 10 from the upright configuration 100 to the rotated configuration 102.

Terms such as "a," "an," and "the" are not intended to refer to only a singular entity, but rather include the general class of which a specific example may be used for illustration.

The phrases "in one embodiment," "in optional embodiment(s)," "in alternative embodiment(s)," and "in an exemplary embodiment," or variations thereof, as used herein do not necessarily refer to the same embodiment, although it may.

As used herein, the phrases "one or more," "at least one," and "one or more of," or variations thereof, when used with a list of items, mean that different combinations of one or more of the items may be used and only one of each item in the list may be needed. For example, "one or more of" item A, item B, and item C may include, for example, without limitation, item A or item A and item B. This example also may include item A, item B, and item C, or item B and item C.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments of whether these features, elements, and/or states are included or are to be performed in any particular embodiment.

The previous detailed description has been provided for the purposes of illustration and description. Thus, although there have been described particular embodiments of new and useful INSULATED COOLER, it is not intended that such references be construed as limitations upon the scope of this disclosure except as set forth in the following claims. Thus, it is seen that the apparatus of the present disclosure readily achieves the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims.

What is claimed is:

1. An insulated cooler, comprising:

an insulated bottom;

an insulated peripheral wall extending up from the bottom such that the bottom and the peripheral wall define an interior space of the cooler;

an insulated lid pivotally attached to the peripheral wall and pivotable to a closed position engaging the peripheral wall to close the interior space;

a vent passage extending through the peripheral wall, the vent passage communicating the interior space with an exterior of the cooler to prevent formation of a vacuum in the cooler;

an air permeable-water impermeable material layer blocking the vent passage to allow air flow through the vent passage while preventing water from leaking out of the vent passage;

a latch arm pivotably attached to the lid; and a retaining frame attached to the peripheral wall to hold the material layer in place relative to the vent passage, the retaining frame including a latch seat configured to be engaged by the latch arm when the lid is in the closed position.

2. The insulated cooler of claim 1, wherein:

the latch arm covers and conceals the vent passage and the material layer when the latch arm is engaged with the latch seat.

3. The insulated cooler of claim 1, wherein:

the vent passage is generally circularly shaped, and the vent passage has a diameter ranging from about 3 mm to about 6 mm.

4. The insulated cooler of claim 3, wherein:

the material layer is generally circularly shaped, and the material layer has a diameter greater than or equal to the diameter of the vent passage.

5. The insulated cooler of claim 1, wherein:

the material layer comprises expanded polytetrafluoroethylene (ePTFE).

6. The insulated cooler of claim 1, wherein:

the material layer has a thickness ranging from about 0.1 mm to about 0.3 mm.

7. The insulated cooler of claim 1, wherein:

the peripheral wall comprises an insulated first sidewall, an insulated second sidewall, an insulated front wall, and an insulated backwall; and the first sidewall, the second sidewall, the front wall, and the backwall extend up from the bottom to define the interior space of the cooler.

8. The insulated cooler of claim 7, wherein:

the lid is pivotally attached to the backwall and pivotable to the closed position engaging the first sidewall, the second sidewall, the front wall, and the backwall to close the interior space.

9. An insulated cooler, comprising:

an insulated bottom;

an insulated peripheral wall extending up from the bottom such that the bottom and the peripheral wall define an interior space of the cooler;

an insulated lid pivotally attached to the peripheral wall and pivotable to a closed position engaging the peripheral wall to close the interior space;

a vent passage extending through the lid, the vent passage communicating the interior space with an exterior of the cooler to prevent formation of a vacuum in the cooler;

an air permeable-water impermeable material layer blocking the vent passage to allow air flow through the vent passage while preventing water from leaking out of the vent passage; and a retaining frame attached to the lid to hold the material layer in place relative to the vent passage;

wherein the retaining frame comprises a plate attached to the lid to hold the material layer in place relative to the vent passage, and wherein the plate covers and conceals the vent passage and the material layer.

10. An insulated container, comprising:

a bottom;

a peripheral wall extending up from the bottom such that the bottom and the peripheral wall define an interior space of the container;

a lid pivotally attached to the peripheral wall and pivotable to a closed position engaging the peripheral wall to close the interior space such that a difference of temperature is generally maintained between the interior space of the container and an exterior of the container;

a vent passage extending through the lid, the vent passage communicating the interior space with the exterior of the container to prevent formation of a suction seal between the lid and the peripheral wall when the lid is engaging the peripheral wall in the closed position;

a retaining frame attached to the lid at a location on the lid corresponding to a location of the vent passage; and an air permeable-water impermeable material layer blocking the vent passage to allow air flow through the vent passage while preventing water from leaking out of the vent passage, the material layer positioned between the retaining frame and the interior space of the container;

wherein the retaining frame comprises a plate attached to the lid at a location corresponding to the location of the vent passage; and wherein the plate covers and conceals the vent passage and the material layer.

11. The insulated container of claim 10, wherein:

the vent passage is generally circularly shaped, and the vent passage has a diameter ranging from about 3 mm to about 6 mm; and the material layer is generally circularly shaped, and the material layer has a diameter greater than or equal to the diameter of the vent passage.

12. The insulated container of claim 10, wherein:

the material layer comprises expanded polytetrafluoroethylene (ePTFE).

13. An insulated container, comprising:

a bottom;

a peripheral wall extending up from the bottom such that the bottom and the peripheral wall define an interior space of the container;

a lid pivotally attached to the peripheral wall and pivotable to a closed position engaging the peripheral wall to close the interior space such that a difference of temperature is generally maintained between the interior space of the container and an exterior of the container;

a vent passage extending through the peripheral wall, the vent passage communicating the interior space with the exterior of the container to prevent formation of a suction seal between the lid and the peripheral wall when the lid is engaging the peripheral wall in the closed position;

a retaining frame attached to the peripheral wall at a location on the peripheral wall corresponding to a location of the vent passage;

an air permeable-water impermeable material layer blocking the vent passage to allow air flow through the vent passage while preventing water from leaking out of the vent passage, the material layer positioned between the retaining frame and the interior space of the container;

a latch arm pivotably attached to the lid; and the retaining frame including a latch seat configured to be engaged by the latch arm when the lid is in the closed position.

14. The insulated container of claim 13, wherein:

the latch arm covers and conceals the vent passage and the material layer when the latch arm is engaged with the latch seat.

15. An insulated container, comprising:

a bottom;

a peripheral wall extending up from the bottom such that the bottom and the peripheral wall define an interior space of the container;

a lid pivotally attached to the peripheral wall and pivotable to a closed position engaging the peripheral wall to close the interior space such that a difference of temperature is generally maintained between the interior space of the container and an exterior of the container;

a vent passage extending through the peripheral wall or the lid, the vent passage communicating the interior space with the exterior of the container to prevent formation of a suction seal between the lid and the peripheral wall when the lid is engaging the peripheral wall in the closed position;

a retaining frame attached to the peripheral wall or the lid at a location on the peripheral wall or the lid corresponding to a location of the vent passage; and an air permeable-water impermeable material layer blocking the vent passage to allow air flow through the vent passage while preventing water from leaking out of the vent passage, the material layer positioned between the retaining frame and the interior space of the container;

wherein the vent passage extending through the peripheral wall or the lid defines a length beginning from an exterior surface of the peripheral wall or the lid and ending at an interior surface of the peripheral wall or the lid; and wherein the material layer is disposed within the vent passage length.

16. A method of preventing a vacuum in a cooler and maintaining a temperature differential in the cooler, the method comprising the steps of:

providing a vent passage through an insulated peripheral wall of the cooler, the peripheral wall extending up from a bottom of the cooler such that the bottom and the peripheral wall define an interior space of the cooler;

concealing the vent passage behind a latch mounted on the peripheral wall such that when the latch is closed the vent passage is concealed from a user of the cooler; and blocking the vent passage with an air permeable-water impermeable material layer thereby allowing air flow through the vent passage while preventing water from leaking out of the vent passage.

17. The method of claim 16, wherein:

the material layer comprises expanded polytetrafluoroethylene (ePTFE).

* * * * *